US007643768B2

(12) United States Patent
Katahira

(10) Patent No.: US 7,643,768 B2
(45) **Date of Patent: *Jan. 5, 2010**

(54) IMAGE FORMING APPARATUS AND METHOD OF CONTROLLING THEREOF

(75) Inventor: Yoshiaki Katahira, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/253,069

(22) Filed: Oct. 16, 2008

(65) Prior Publication Data

US 2009/0087204 A1 Apr. 2, 2009

Related U.S. Application Data

(63) Continuation of application No. 11/552,613, filed on Oct. 25, 2006, now Pat. No. 7,509,067.

(30) Foreign Application Priority Data

Nov. 18, 2005 (JP) ..... 2005-334320

(51) Int. Cl.
*G03G 15/00* (2006.01)

(52) U.S. Cl. ..... 399/75; 399/86

(58) Field of Classification Search ..... 399/75, 399/81, 82, 83, 85, 86, 370, 376
See application file for complete search history.

(56) References Cited

U.S. PATENT DOCUMENTS 4,835,572 A 5/1989 Ide
5,084,741 A * 1/1992 Takemura et al. ..... 399/373
6,343,197 B1 * 1/2002 Serizawa et al. ..... 399/82
6,810,219 B2 10/2004 Yokobori et al.
6,963,721 B2 11/2005 Asai et al.
7,102,766 B2 9/2006 Asakawa et al.
7,280,782 B2 10/2007 Maeda et al.
7,377,506 B2 * 5/2008 Miyajima ..... 271/9.03

FOREIGN PATENT DOCUMENTS

JP 07-072553 A 3/1995
JP 07-160148 A 6/1995
JP 07-240836 A 9/1995

OTHER PUBLICATIONS

Non-Final Office Action for U.S. Appl. No. 11/552,613, filed Aug. 19, 2008.

* cited by examiner

*Primary Examiner*—Hoan H Tran
(74) *Attorney, Agent, or Firm*—Canon USA Inc IP Division

(57) ABSTRACT

An image forming apparatus is capable of executing an auto paper selection function for automatically selecting a paper size corresponding to a paper size of an input document from a plurality of paper cassettes, and an auto magnification selection function for automatically magnifying an image of the input document to correspond to a defined paper size. The auto magnification selection function is selected for execution by the apparatus when there is only one size of paper to be selected in the apparatus, and the auto paper selection function is selected for execution by the apparatus when there are a plurality of sizes of paper to be selected in the apparatus.

2 Claims, 12 Drawing Sheets

IMAGE FORMING APPARATUS AND METHOD OF CONTROLLING THEREOF

CROSS-REFERENCE TO RELATED APPLICATIONS

This application is a Continuation of U.S. patent application Ser. No. 11/552,613 filed Oct. 25, 2006, which claims the benefit of Japanese Application No. 2005-334320 filed Nov. 18, 2005, both of which are hereby incorporated by reference herein in their entirety.

BACKGROUND OF THE INVENTION

1. Field of the Invention

The present invention relates to an image forming apparatus having an APS (Auto Paper Selection) function and an AMS (Auto Magnification Selection) function.

2. Description of the Related Art

An image forming apparatus having a copier function is known which has an auto paper selection function and an auto magnification selection function. The auto paper selection function is used to automatically select an optimum size of paper, based on a document size and the copying magnification. The auto magnification selection function is used to automatically set an optimum level of the copy magnification based on the document size and a selected paper size. Japanese Patent Application Laid-Open No. 7-240836 discusses an image forming apparatus including an auto paper selection (hereinafter referred to as APS) function and an auto magnification selection (hereinafter referred to as AMS) function.

In such an image forming apparatus, either an APS or AMS function is usually set in an initial state (default state) at the time the apparatus is just turned on. In such a case, a user needs to register and set either an APS or AMS function as an initial state in advance.

The APS function is used to automatically select a paper size corresponding to a paper size of the document, from plural sizes of paper contained in the image forming apparatus. This function may be useless, when an image forming apparatus has only one size of paper. In such a case, the AMS function may be useful because a scanned image of the input document may need to be magnified to a size corresponding to the one available paper size.

However, conventional image forming apparatuses follow a function which has been registered as the default setting, even if the apparatuses include only one size of paper. That is, the APS is set, even in a case where the APS function is not useful. In this case, the user manually inputs an instruction to change the APS to AMS function.

As described above, according to the conventional technique, the user needs to manually input the instruction to change the APS to/from AMS function each time in accordance with a status (e.g. whether there is only one paper size or there are a plurality of paper sizes, etc.) of the image forming apparatus. This places a burden on the user.

SUMMARY OF THE INVENTION

The present invention has been made in consideration of the above problem. This invention is directed to relieving a user's burden, by automatically setting an APS or AMS function, in accordance with a status of an image forming apparatus.

According to a first aspect of the present invention, an image forming apparatus includes: a plurality of paper cassettes each of which can contain different sizes of paper; an input unit configured to input a document; a detection unit configured to detect a paper size of the document; a control unit configured to execute a set function, of an auto paper selection function for automatically selecting a paper size corresponding to the paper size detected by the detection unit from the plurality of paper cassettes, and an auto magnification selection function for automatically magnifying an image of the document so as to correspond to a specified paper size; an image forming unit configured to form an image on a recording paper based on the document input by the input unit; and an initial state setting unit configured to set the auto magnification selection function in an initial state of the image forming apparatus when there is only one size of paper to be selected in the image forming apparatus, and to set the auto paper selection function in an initial state of the image forming apparatus when there are a plurality of sizes of paper to be selected in the image forming apparatus.

Further features of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE EMBODIMENTS

Embodiments of the invention will be described in detail below with reference to the drawings.

Figure 1:
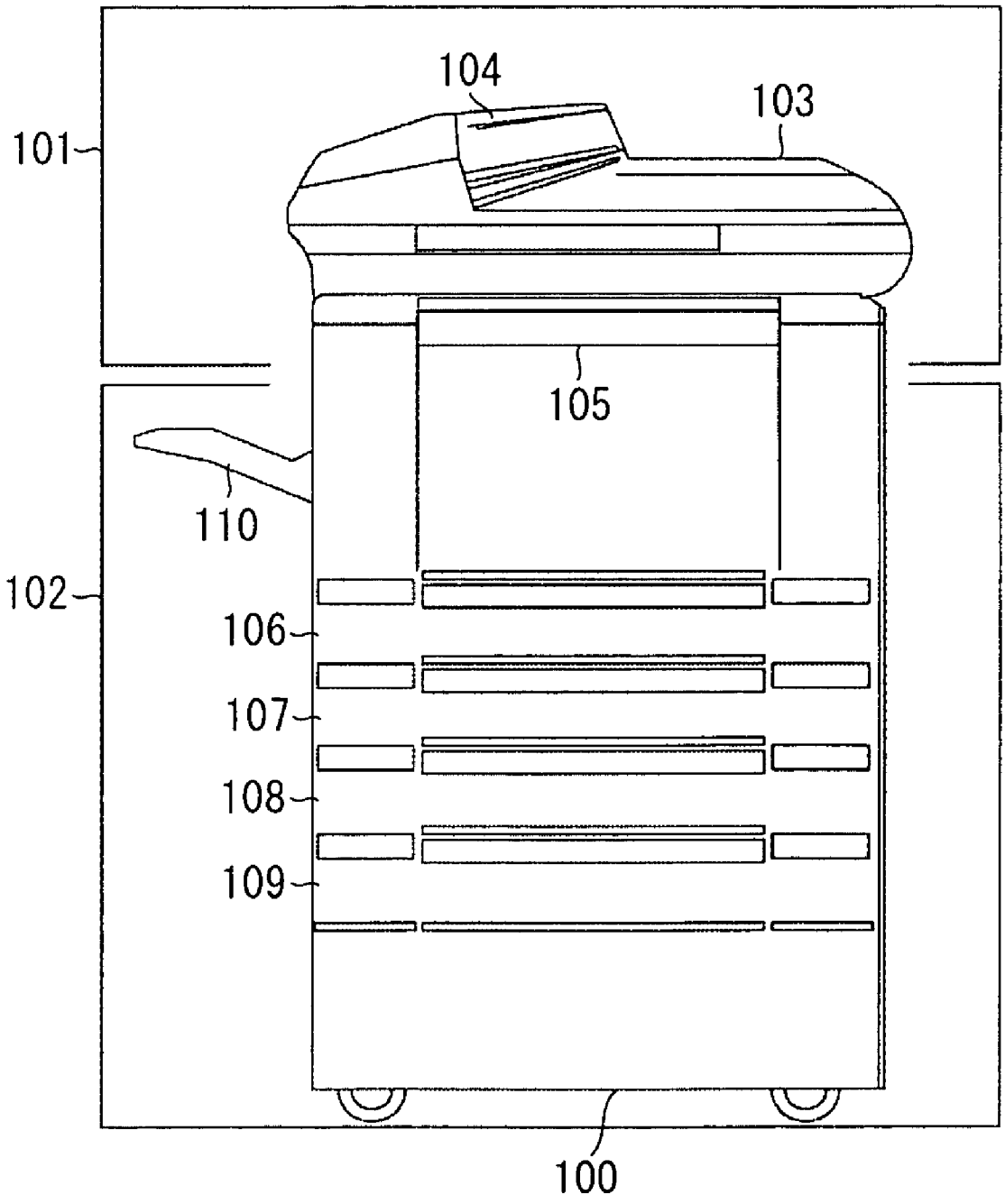
FIG. 1 is a view showing a copier according to an embodiment of this invention.

FIG. 1 is a view showing a copier 100 serving as an image forming apparatus according to an embodiment of the present invention. The copier 100 includes a scanner unit 101 serving as an image input device and a printer unit 102 as an image forming device. The scanner unit 101 serving as the image input device illuminates an image on a document, and controls a CCD line sensor (not shown) to scan the image, thereby reading the image and converting the read image into raster image data in a form of electrical signals. Document paper is set onto a tray 104 of a document feeder 103. When a user inputs a read start instruction from an operating unit 105, a controller CPU sends the instruction to the scanner 101, and the feeder 103 feeds the document paper one after another so as to start a operation for reading images on the documents.

The printer unit 102 serving as the image forming device converts the electrical raster image data into a visible image on a recording paper. The printer unit may employ any scheme such as the electrophotographic type using a photosensitive drum or photosensitive belt or the inkjet type for printing an image directly on a paper by discharging ink from a micro nozzle array. The printing operation is activated in response to an instruction from the controller CPU. The printer unit has a plurality of paper feed stages so as to select different paper sizes or different paper directions therefrom, and has paper cassette 106, 107, 108 and 109 respectively corresponding thereto. A discharge tray 110 receives printed paper.

FIG. 1 shows the copier as an example of the image forming apparatus. The image forming apparatus may be a multifunction peripheral having a facsimile function, etc. Though the copier 100 of FIG. 1 has the plurality of paper cassettes, the present invention can be applied to an image forming apparatus having only one paper cassette.

Figure 2:
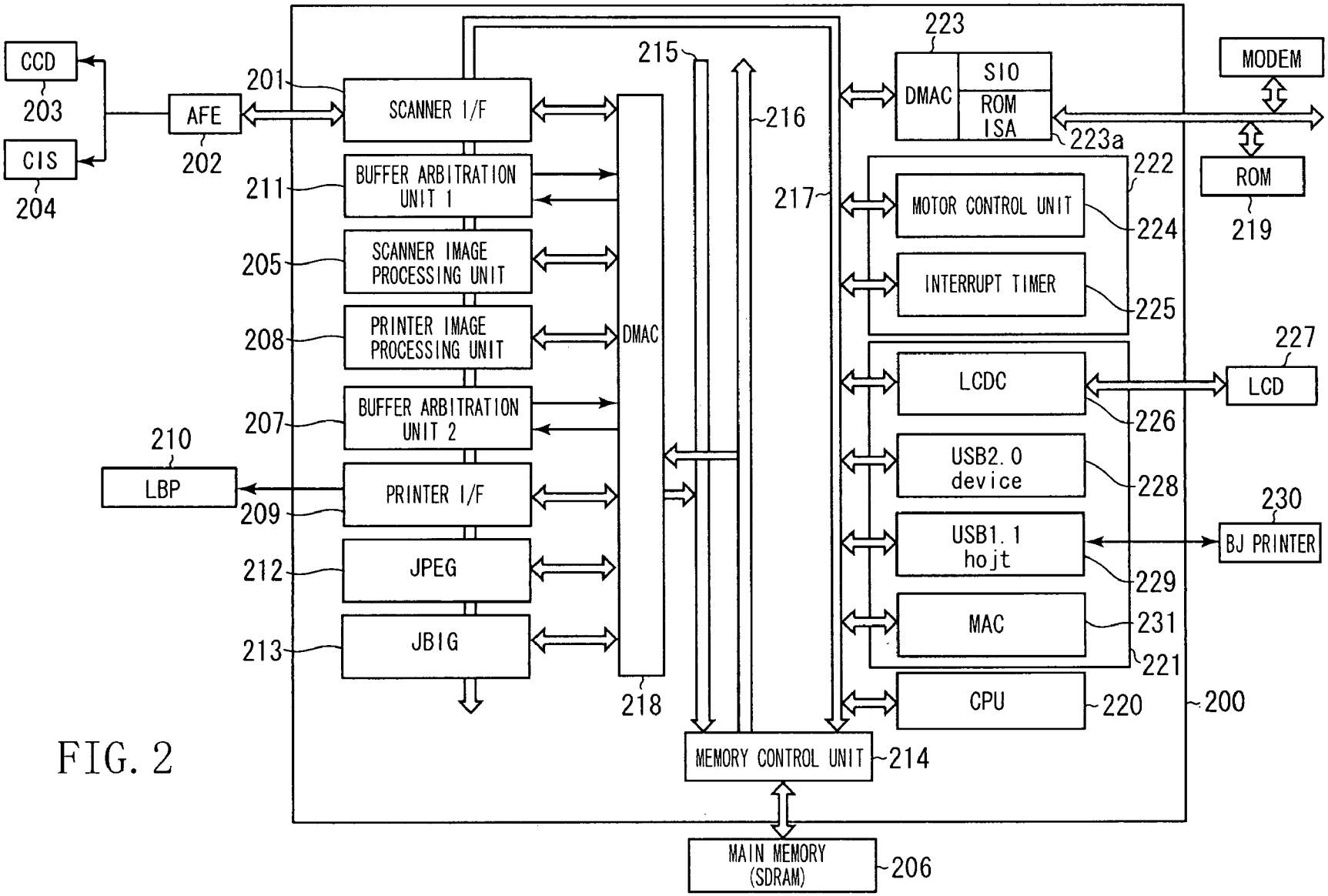
FIG. 2 is a block diagram showing an internal configuration of the copier according to an embodiment.

FIG. 2 is a block diagram showing an internal configuration of the copier 100 according to the embodiment of the present invention.

A controller unit 200 is coupled to a scanner (which reads images on a document) serving as an image input device and a printer (which records and outputs a visible image) serving as an image forming device, and inputs/outputs image information and the like. The network communications can be possible, if the controller unit 200 is connected to a LAN or public line (PSTN or ISDN) through a network I/F (not shown).

A scanner interface (hereinafter referred to as "scanner I/F") unit 201 is connected to a charge-coupled device (CCD) 203, and a contact image sensor (CIS) 204 through an Analog Front End (AFE) 202. As a result, the read data can be transmitted to the controller unit 201 without going through the individual dedicated circuits.

A scanner image processing unit 205 executes image processing for image data, which is expanded in a main memory 206 by a process of the scanner I/F unit 201, in accordance with an image processing operational mode (color copy, monochrome copy, color scanning, monochrome scanning, etc.).

A buffer mediation unit 207 mediates between data writing and reading, when data transmission is performed between the scanner I/F unit 201 and the scanner image processing unit through a ring buffer area in the main memory 206.

A printer image processing unit 208 performs area editing of an input image and converts the resolution thereof, and outputs obtained image data from a printer. A printer interface (I/F) 209 outputs an image-processing result onto a laser beam printer (LBP) 210 connected thereto.

A buffer mediation unit 211 mediates between data writing and reading, when data transmission is performed between the printer image processing unit 208 and the printer interface 209 through the ring buffer area in the main memory 206. The buffer mediation units 207 and 211 are blocks having the same basic configuration. However, different methods for controlling the mediation units may be used depending on their use.

A JPEG module 212 and a JBIG module 213 are processing units compressing and expanding image data in accordance with a predetermined standard.

A memory control unit 214 is connected to a first and second buses 215 and 216 for an image processing system and also connected to a third bus 217 for a computer system. The memory control unit controls data transfer for writing and reading data into and from the main memory (SDRAM) 206.

A DMA controller (DMAC) 223 is connected to a ROM 219 through a ROMISA 223*a* in association with the memory control unit 214. The DMA controller generates and sets predetermined address information for controlling DMA and representing data transmission/reception between any external device or various interface sections and the main memory 206.

A DMA controller (DMAC) 218 generates and sets predetermined address information for controlling DMA and regarding data transmission/reception between each of the image processing units (201, 205, 208, 209) and the main memory 206 in association with the memory control unit 214. For example, the DMA controller 218 generates address information, for each DMA channel, for DMA transferring image data that is read by the scanner I/F unit 201 to the main memory 206, in accordance with the kind of the image reader device (i.e. the CCD 203 and CIS 204). The DMA controller 218 generates address information for reading image data expanded in the main memory 206 in accordance with a DMA channel, and DMA transfers the read image data to the scanner image processing unit 205.

The ROM 219 stores control parameters and control program data corresponding to the image reader devices (CCD 203 and CIS 204), and can set various control parameters in accordance with each of the image reader devices. The image data can be input in accordance with a data output system of each of the CCD 203 and the CIS 204. Therefore, there is no need to provide dedicated interface circuits.

The first BUS 215 enables the data read from the main memory 216 to be sent to each processing unit of the image processing system. The second BUS 216 enables the data read from each processing unit of the image processing system to be sent to the main memory 206. The first BUS and the second BUS are paired with each other so as to allow image data transmission/reception between the image processing block and the main memory 206. The third BUS for computer system 217 is connected to a CPU 220, a communication and user interface control unit 221, a mechatronics system control unit 222, control registers inside the image processing units and the DMAC 223.

The mechatronics system control unit 222 includes a motor control unit 224 and an interrupt timer control unit 225. The interrupt timer control unit 225 controls the activation timing of the motor and controls the timing for processing synchronization in the image processing system.

A LCD control unit (LCDC) 226 controls display of various setting of the image processing apparatus and its processing status, on a LCD 227.

USB interface sections 228 and 229 enable connections with the peripherals. FIG. 2 shows a state where the USB interface unit 229 is connected to a BJ-printer 230.

A media access control (MAC) unit 231 controls timing in which data is transmitted to any of its connected devices (accessed).

The CPU 220 controls the entire operations of the controller unit 200.

The scanner I/F unit 201 can correspond to the CCD 203 and the CIS 204, as the image reader devices, and inputs signals of those image reader devices. This input image data is DMA transferred by the memory control unit 214, and is expanded in the main memory 206.

Figure 3:
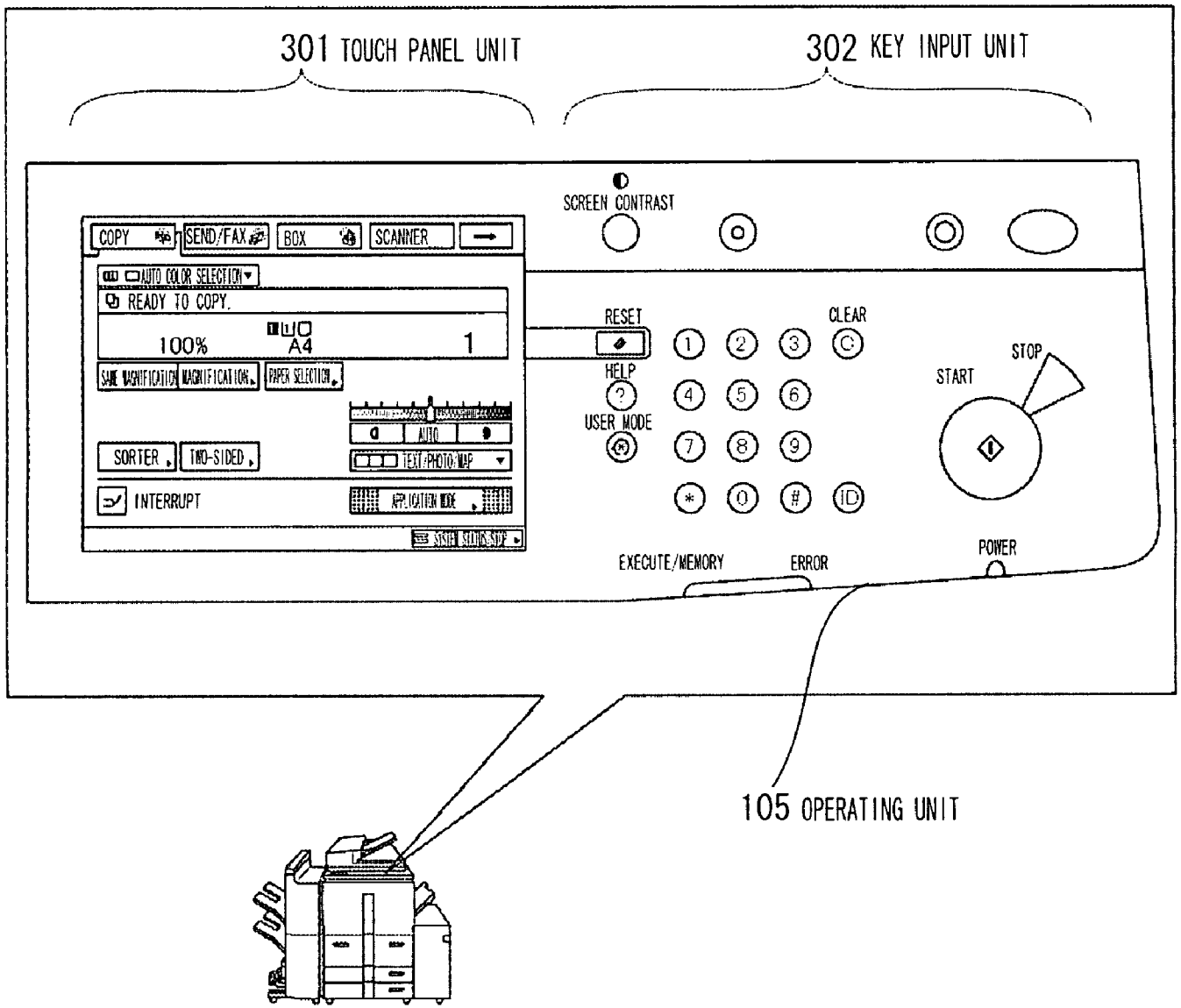
FIG. 3 is a view showing an operating unit of the copier according to an embodiment.

FIG. 3 is a view showing an example of the operating unit 105 shown in FIG. 1.

The operating unit 105 includes a touch panel unit 301 and a key input unit 302.

The touch panel unit 301 is an interface for displaying a screen for setting each function of the copier 100, the present set state, the state of the apparatus, etc. The touch panel unit 301 employs a LCD and a touch panel input system. The user directly touches the touch panel unit 301 so as to operate the copier.

The key input unit 302 is an interface for supplementing the touch panel unit 301. For example, the user can turn on or off the copier, execute or cancel each function, input numerical values and clear the settings, through the key input unit 302. Some operations can be done by both the key input unit 302 and the touch panel unit 301, but some other operations cannot.

The image forming apparatus according to this embodiment can execute an auto paper selection (APS) function for automatically selecting an optimum paper size based on the document size and the available paper cassettes. Further, the image forming apparatus can execute an auto magnification selection (AMS) function for setting the optimum copy magnification based on the document size and the selected paper size.

Figure 4:
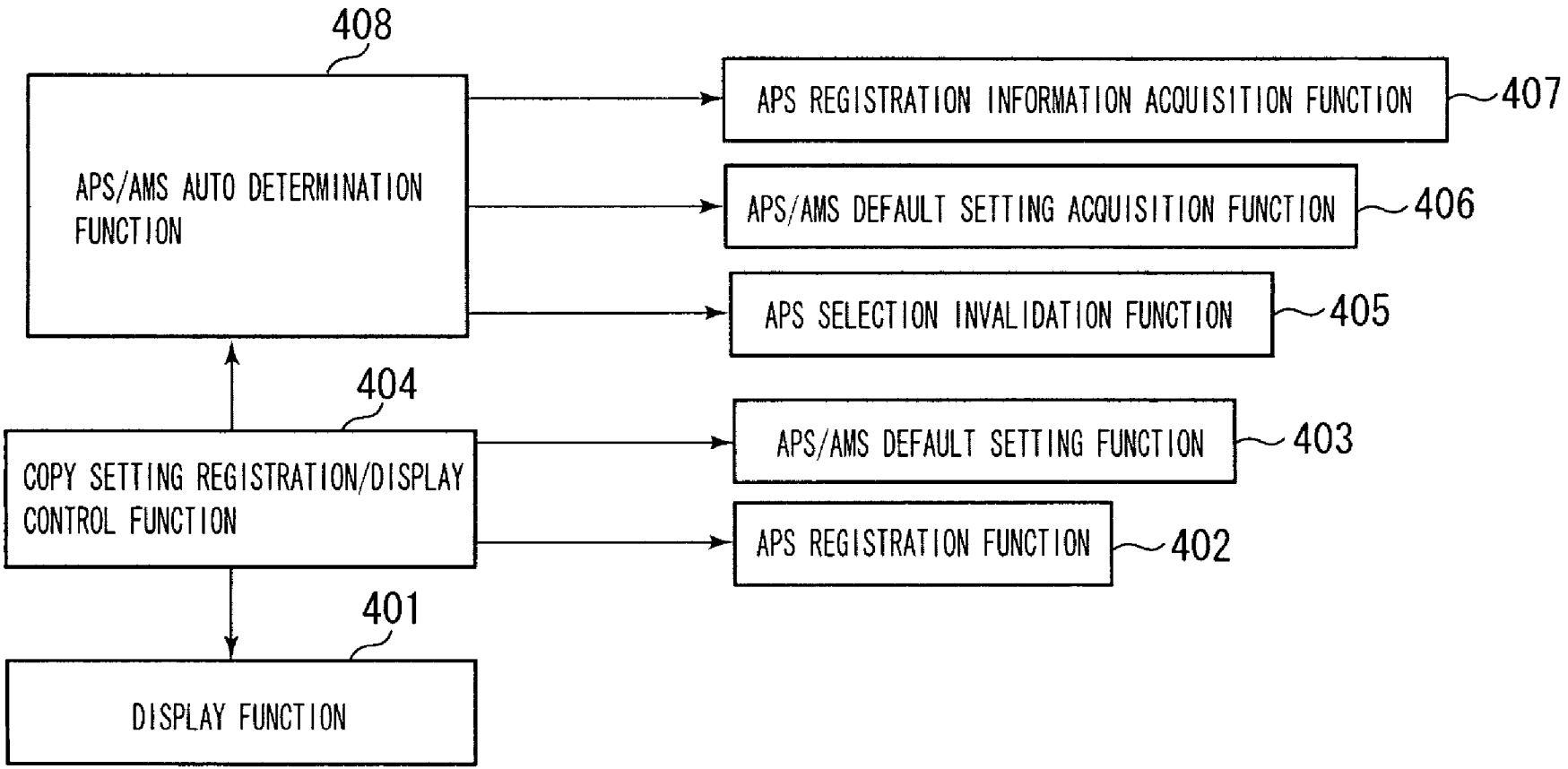
FIG. 4 is a block diagram schematically showing functions to be executed by the copier according to an embodiment.

FIG. 4 is a block diagram schematically showing functions executed by the CPU 220, when the copier 100 of this embodiment executes the APS or AMS.

FIG. 5 to FIG. 11 are views each showing an example of a display screen shown on the touch panel unit 301 of the copier 100 according to this embodiment.

In FIG. 4, a display function 401 controls a display screen displayed on the touch panel unit 301 using the LCD control unit 226.

An APS registration function 402 registers a candidate cassette(s) to be selected from a plurality of paper cassettes, when the APS is set.

Figure 5:
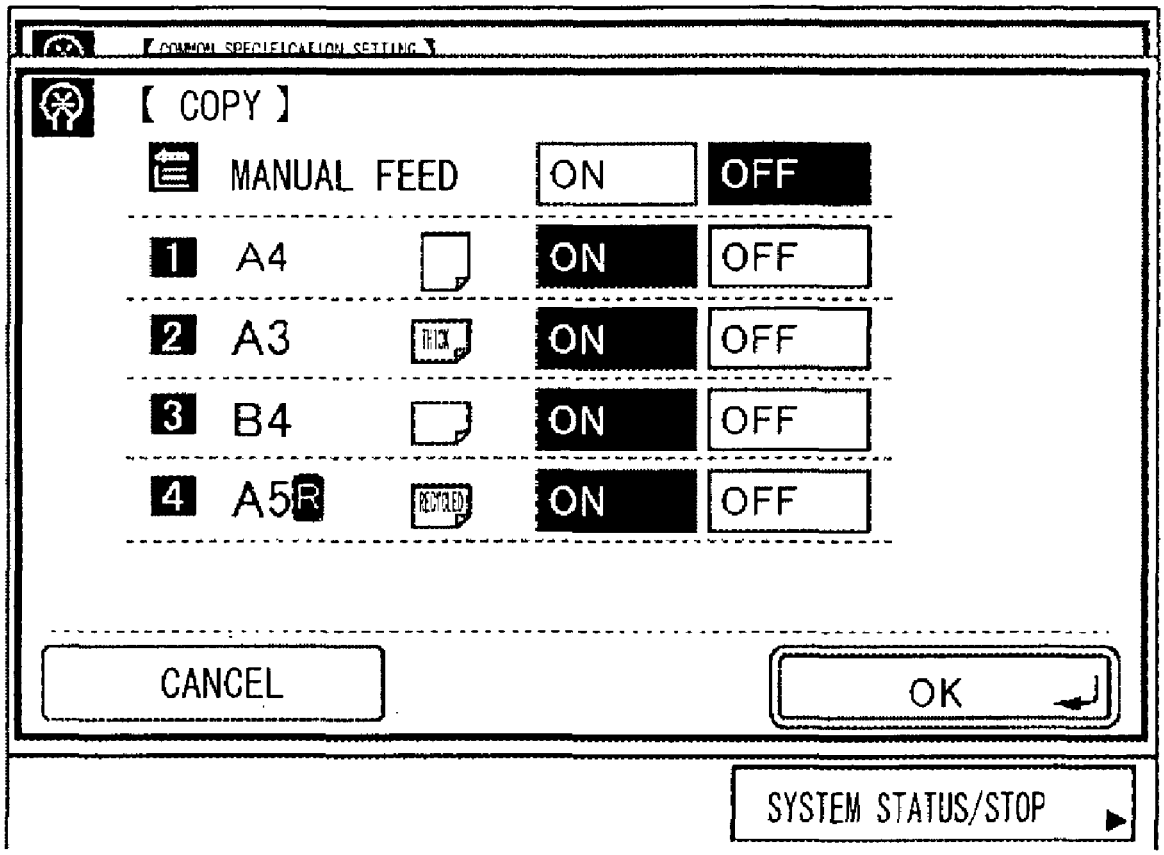
FIG. 5 is a view showing an example of a touch panel display screen at the time of executing an APS registration function according to an embodiment.

FIG. 5 is a view showing an example of a display screen of the touch panel unit 301 when executing the APS registration function 402. As shown in FIG. 5, the copier 100 of this embodiment has a manual feed cassette and paper cassettes 1 to 4. The user can specify "ON" or "OFF" in association with each candidate paper cassette so as to register the candidate paper cassette, when the APS is set for each cassette. In FIG. 5, the paper cassettes 1 to 4 are registered as candidates to be selected, while the manual feed paper cassette is not registered as a candidate to be selected in the APS.

An APS/AMS default setting function 403 sets either APS or AMS to be effective in an initial state (default state), at the time the copy function is used. In an embodiment, both APS and AMS can not be effective at the same time.

Figure 6:
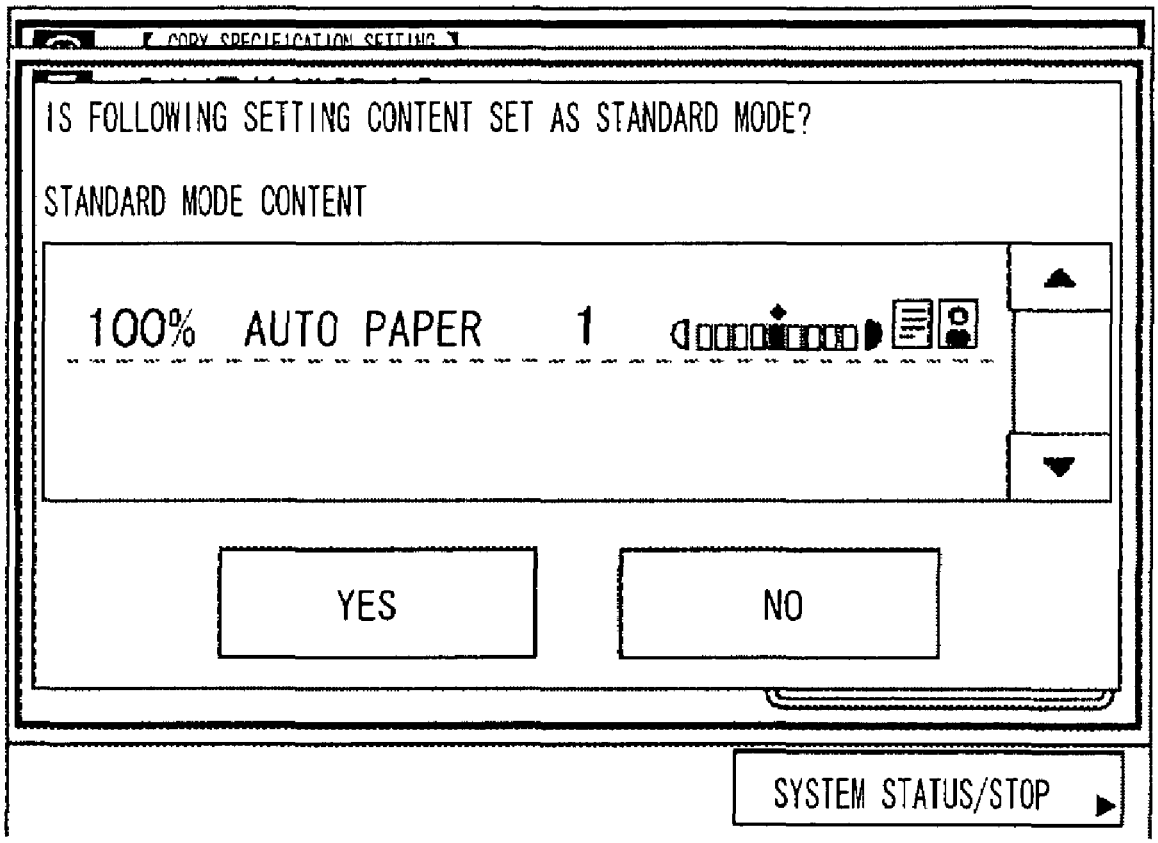
FIG. 6 is a view showing a display screen when APS is set in an initial state at the time of using a copy function according to an embodiment.

FIG. 6 is a view showing a display screen when the APS is set in an initial state (described as "standard mode" in FIG. 6) at the time the copy function is used. In FIG. 6, if the user presses a button "Yes", the APS can be effectively set in the initial state of using the copy function.

Figure 7:
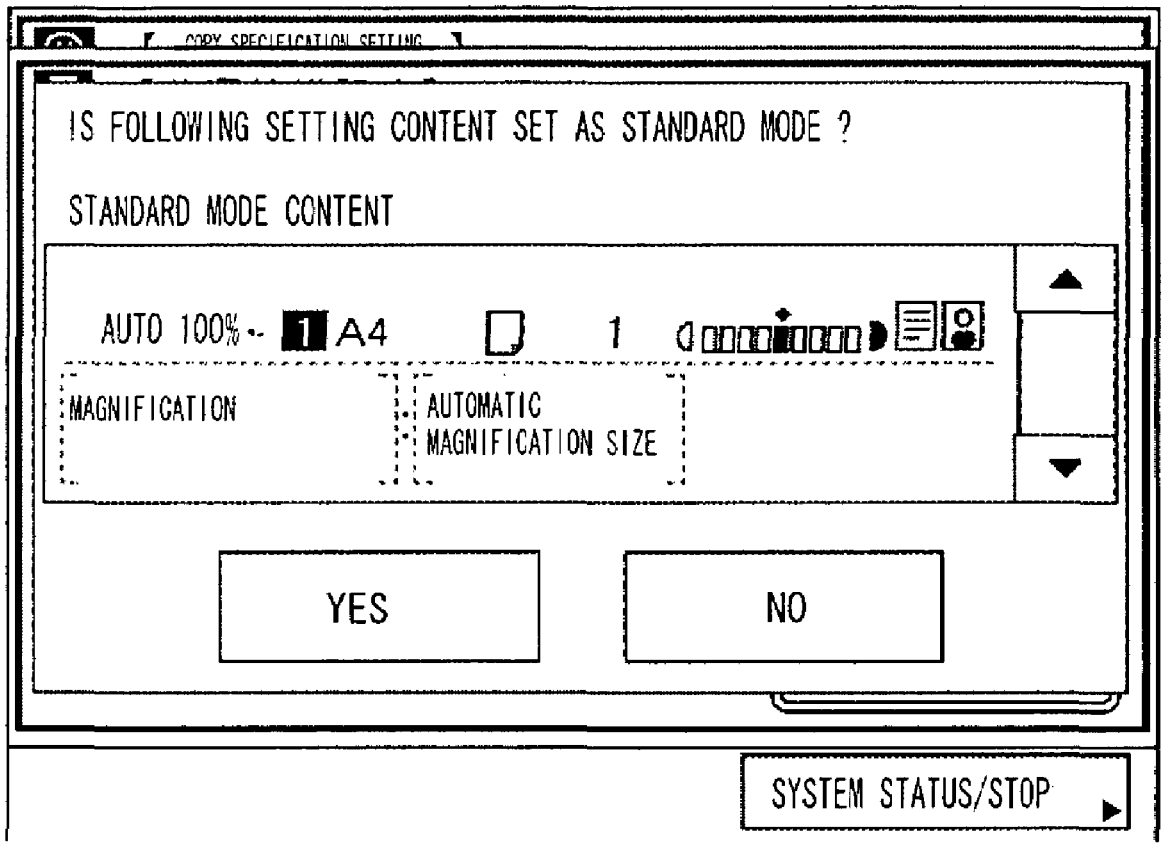
FIG. 7 is a view showing a display screen when AMS is set in an initial state at the time of using a copy function according to an embodiment.

FIG. 7 is a view showing a display screen when the AMS is set in an initial state (described as "standard mode" in FIG. 7) at the time the copy function is used. In FIG. 7, if the user presses a button "Yes", the AMS can be effectively set in the initial state of using the copy function.

A copy setting registration/display control function 404 controls the display function 401 to display registration of the copy settings, information for the registration and the content of the present settings, based on a determination result of an APS/AMS auto determination function 408 as will be described later.

Figure 8:
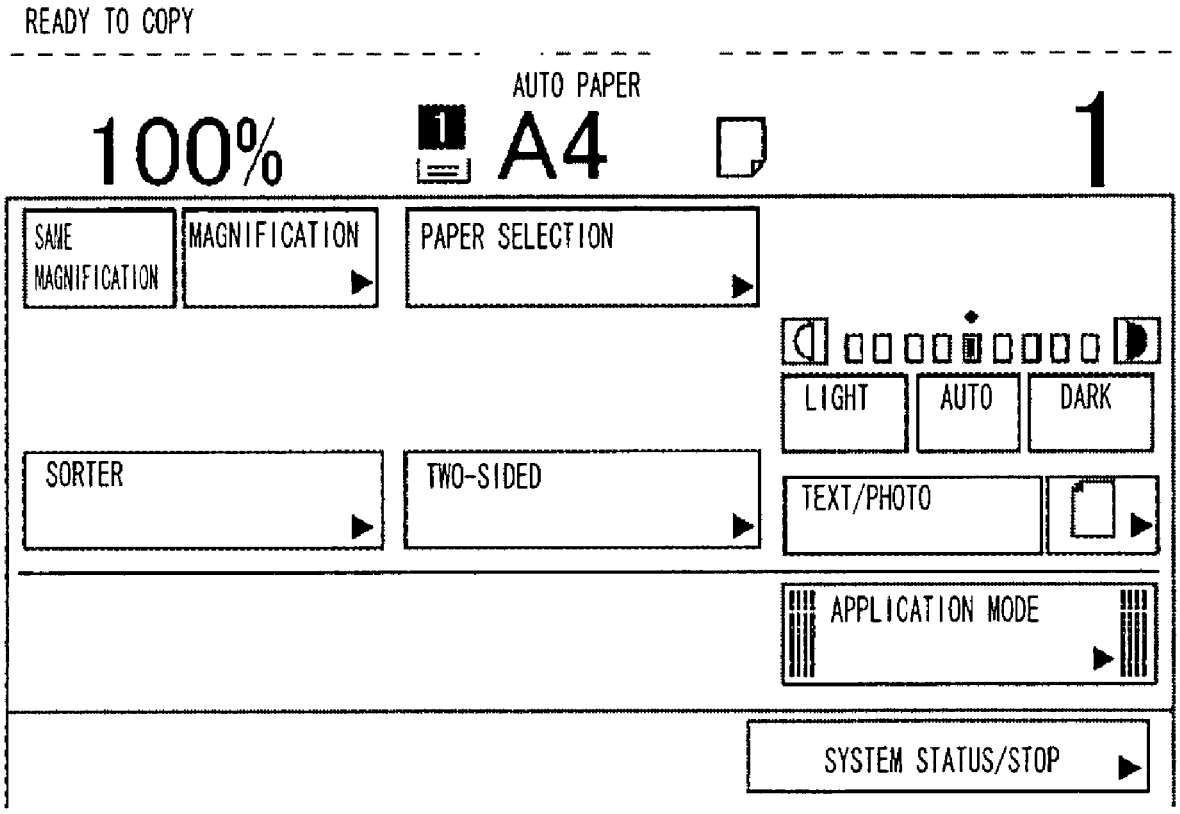
FIG. 8 is a view showing a touch panel display screen when APS is effectively set according to an embodiment.

FIG. 8 shows a display screen of the touch panel unit 301 when the APS is effectively set.

Figure 9:
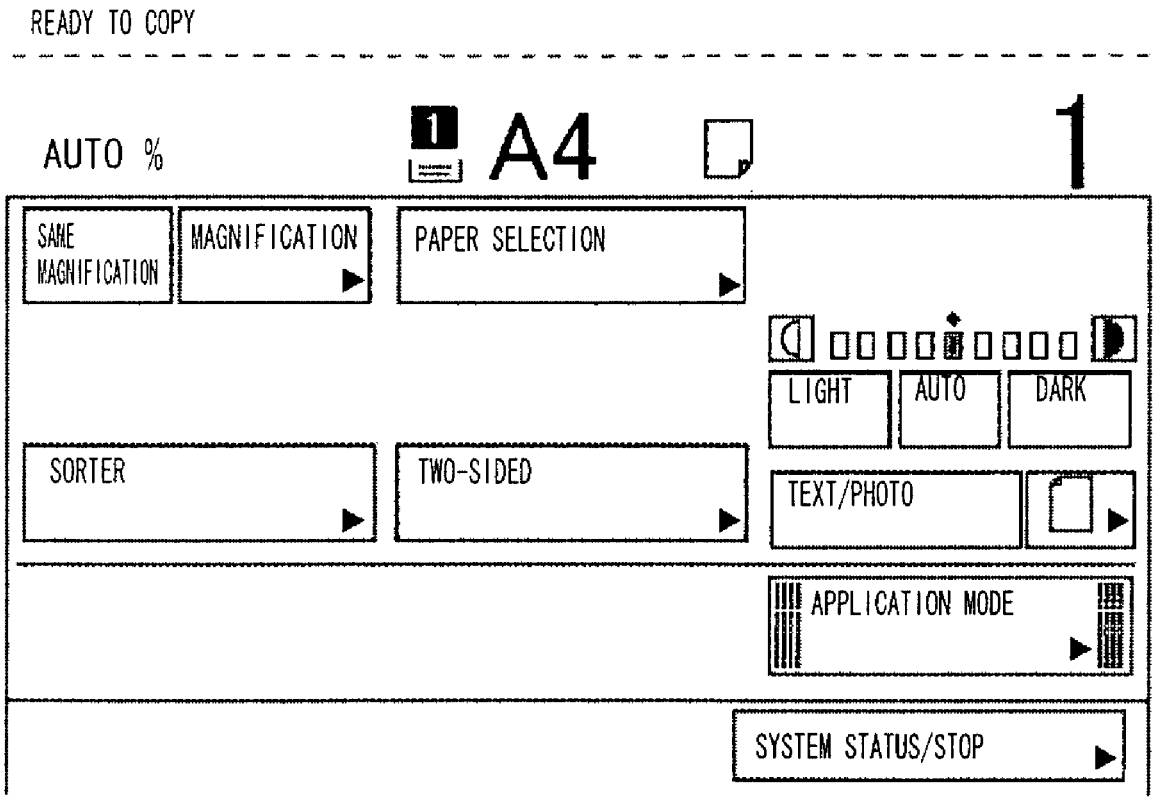
FIG. 9 is a view showing a touch panel display screen when AMS is effectively set according to an embodiment.

FIG. 9 shows a display screen of the touch panel unit 301 when the AMS is effectively set.

An APS selection invalidation function 405 prohibits the user from selecting the APS by graying out or deleting the display for setting the APS. When the APS is set in the initial state at the time the copy function is used, the APS selection invalidation function 405 releases this APS setting. Of the plurality of paper cassettes, the paper cassette of the uppermost stage is selected as an output paper cassette, and the AMS is set therefor. Note that the paper cassette may be selected from any stage other than the uppermost stage.

Figure 10:
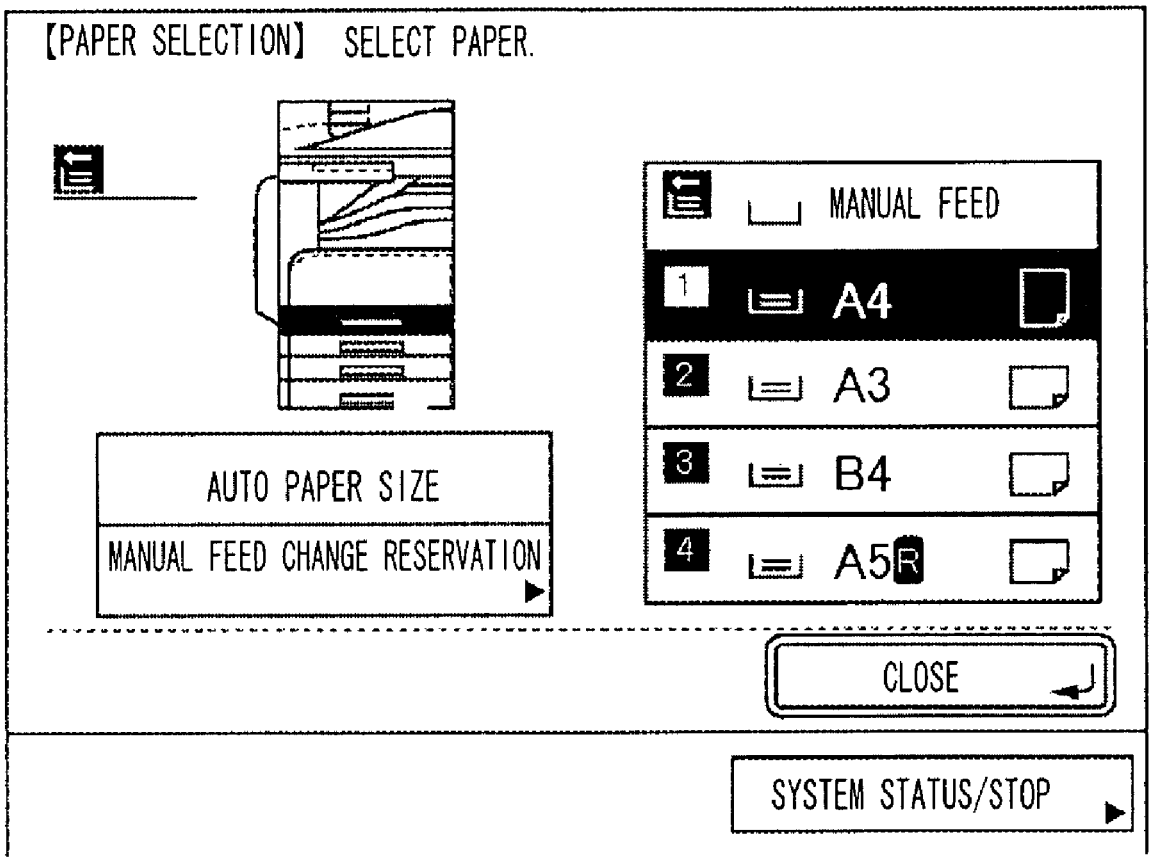
FIG. 10 is a view showing an example of a touch panel display screen showing the state in which a user can input an instruction for setting the APS according to an embodiment.

FIG. 10 shows an example of a display screen of the touch panel unit 301 showing a state that the user can input an instruction for setting the APS. In FIG. 10, if the user presses a button "Auto paper selection", the APS is effectively set at the time of using the copy function.

Figure 11:
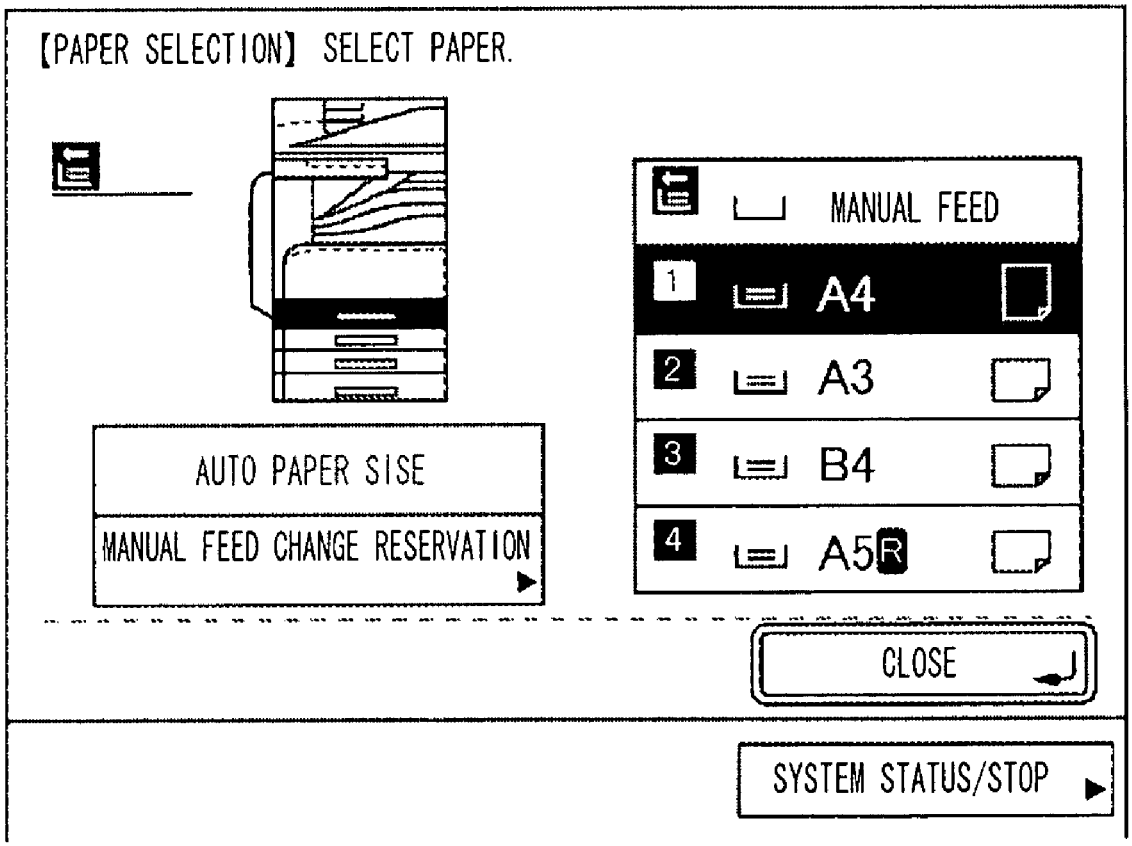
FIG. 11 is a view showing an example of a touch panel display screen showing the state in which a user cannot input an instruction for setting the APS according to an embodiment.

FIG. 11 shows a display screen of the touch panel 301 showing a state in which the user cannot input an instruction for setting the APS. In FIG. 11, because the button "Auto paper selection" is grayed out, the user cannot press the button.

An APS/AMS default setting acquisition function 406 acquires default setting information that is set by the user using the APS/AMS default setting function 403. When the AMS is set, the default paper cassette is specified.

An APS registration information acquisition function 407 acquires information representing the stage of the paper cassette and its paper size that are set by the user using the APS registration function 402.

An APS/AMS auto determination function 408 determines which of the APS or AMS should be effectively set, based on the information acquired by the APS registration information acquisition function 407 and the APS/AMS default setting acquisition function 406. As a result of the determination, if the AMS is effectively set, the user is prohibited from selecting the APS by the APS selection invalidation function 405.

Figure 12:
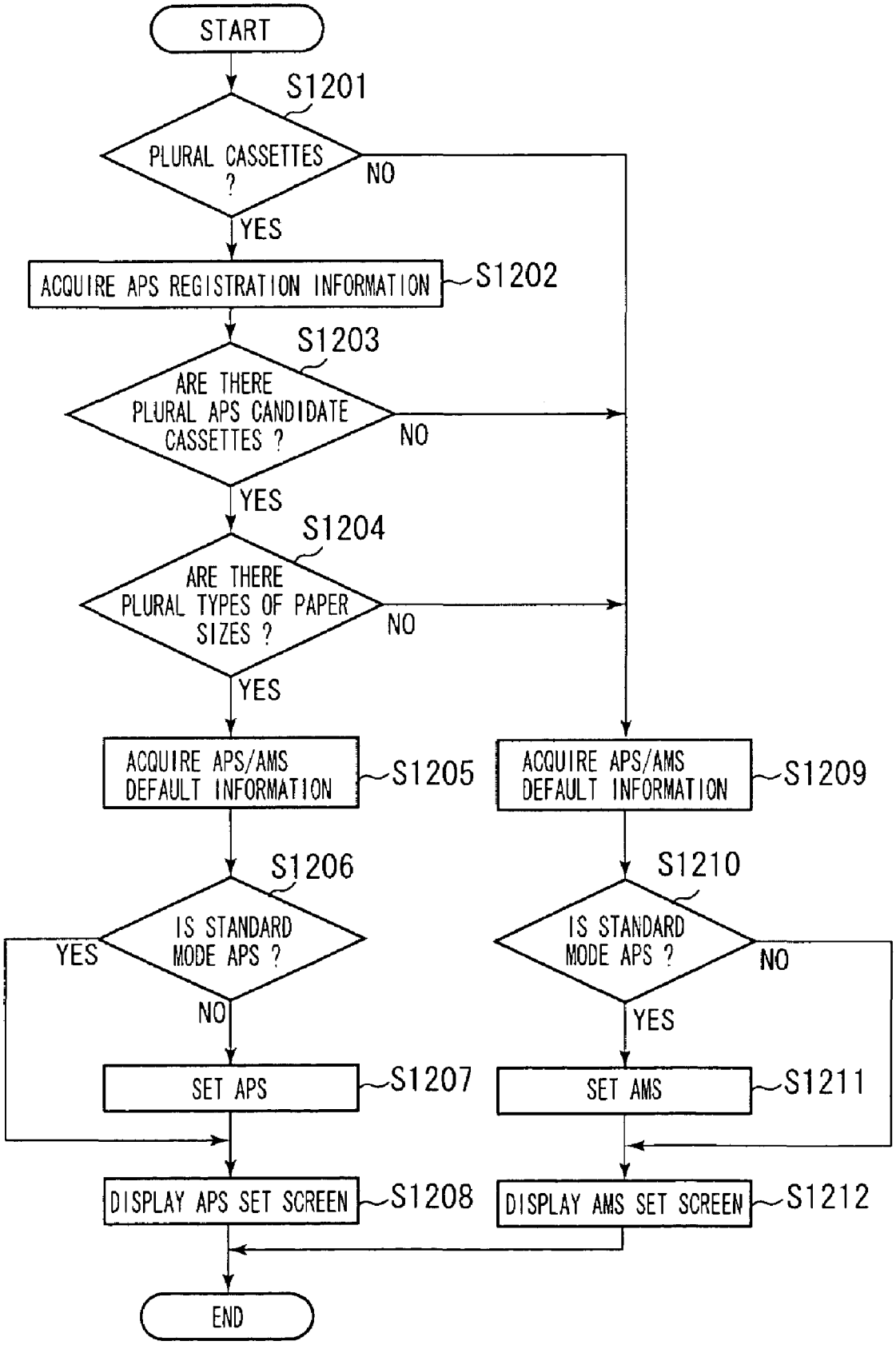
FIG. 12 is a flowchart regarding a process that is executed by the copier according to an embodiment.

FIG. 12 is a flowchart regarding a process for automatically determining and setting which of the APS or AMS is effectively set in the copier 100 according to an embodiment. The CPU 220 included in the copier carries out each step of this flowchart by executing the programs stored in the memory. Specifically, the flowchart of FIG. 12 describes the process of the APS/AMS auto determination function 408. The process of this flowchart may be executed, for example, when the copier is turned on, restarted or its reset button is pressed.

In step S1201, the CPU 220 determines whether the copier 100 has a plurality of paper cassettes. In this embodiment, the copier 100 has a plurality of paper cassettes 106 to 109, and the procedure advances to step S1202. On the other hand, if the copier 100 has only one paper cassette, the procedure advances to step S1209.

In step S1202, the APS registration information acquisition function 407 acquires information representing the stage of the paper cassette and its paper size that are set by the user using the APS registration function 402.

In step S1203, the APS/AMS auto determination function 408 determines whether a plurality of paper cassettes are set as candidate cassettes to be selected in the APS, based on the obtained information in step S1202. If it is determined that a plurality of paper cassettes are set as candidate cassettes, the procedure advances to step S1204. On the contrary, if only one paper cassette is set as a candidate cassette, the procedure advances to step S1209.

In step S1204, the APS/AMS auto determination function 408 determines whether there are plural sizes of paper, based on information obtained in step S1202 and representing sizes of the paper contained in the paper cassettes. If it is determined that there are plural sizes of paper, the procedure advances to step S1205. On the contrary, if there is only one paper size, the procedure advances to step S1209.

In step S1205, the APS/AMS default setting acquisition function 406 obtains information regarding the default setting that is set by the user using the APS/AMS default setting function 403. Specifically, the function 406 obtains information representing whether the APS or AMS is set in the initial setting (standard mode) when executing the copy function.

In step S1206, the APS/AMS auto determination function 408 determines whether the APS is set as the standard mode, based on the information obtained in step S1205. As a result of the determination, if it is determined that the APS is set, the procedure advances to step S1208. On the contrary, if the AMS is set, the procedure advances to step S1207.

In step S1207, the copy setting registration/display control function 404 switches the setting from the AMS to APS as the standard mode. In this switching, the APS/AMS default setting function 403 may switch the setting of the standard mode, or the setting of the standard mode may not necessarily be switched. That is, the mode at the time of executing the copy function can be temporarily switched to the APS. If the APS is effectively set as the initial state of the copier 100 in step S1207, the procedure advances to step S1208.

In step S1208, the copy setting registration/display control function 404 controls the display function 401 to display a display screen (FIG. 8) showing that the APS has been set.

In step S1209, the APS/AMS default setting acquisition function 406 obtains default setting information that is set by the user using the APS/AMS default setting function 403. Specifically, the function 406 obtains information representing whether the APS or AMS is set in the initial setting (standard mode) when executing the copy function.

In step S1210, the APS/AMS auto determination function 408 determines whether the APS is set as the standard mode, based on the information obtained in step S1209. As a result of the determination, if the APS has been set, the procedure advances to step S1211. On the contrary, if the AMS has been set, the procedure advances to step S1212.

In step S1211, the copy setting registration/display control function 404 switches the standard mode from the APS to AMS. In this switching, the APS/AMS default setting function 403 may switch the setting of the standard mode, or the setting of the standard mode may not necessarily be switched. That is, the mode at the time of executing the copy function can be temporarily switched to the AMS. In step S1211, the APS selection invalidation function 405 sets the APS not to be selected by the user. Specifically, the display for setting/selecting the APS is grayed out or deleted so that the user can not select the APS. In step S1211, the CPU effectively sets the AMS as the initial state of the copier 100 so that the APS cannot to be selected by the user. Then, the procedure advances to step S1212.

In step S1212, the copy setting registration/display control function 404 controls the display function 401 to display a display screen (FIG. 9) showing that the AMS has been set.

As described above, in this embodiment, even if the AMS has been set in the initial setting at the time of executing the copy function, the APS will automatically be set when there are plural sizes of paper to be selected. On the other hand, even if the APS has been set in the initial setting at the time of executing the copy function, the AMS will automatically be set when there is only one size of paper to be selected. As a result, the copier of this embodiment does not bother the user with an unnecessary process for setting the APS even though there is only one size of paper to be selected. The user does not need to instruct the copier for changing the setting in such a case. Further, because the user cannot instruct to set the APS, the copier is prevented from being meaninglessly set by the user by mistake.

When there are plural sizes of paper to be selected, the APS is automatically set even if the user does not set the APS each time. On that point, convenience for the user in operations can be improved.

The present invention may be applied to either a system including a plurality of components or a device including only one component. A storage medium, on which program codes of software for realizing the functions of the above-described embodiment are stored, may be supplied to a system or a device. The present invention may be attained by the computer (or CPU, MPU, etc.) of the system or the device reading and executing the program codes stored on the storage medium.

In this case, the program codes per se read from the storage medium realize the functions of the embodiment. That is, the storage medium storing such program codes is included in the present invention. The storage medium for providing the program codes includes, for example, a floppy (registered trademark) disk, a hard disk, an optical disk, a magneto-optical disk, a CD-ROM, a CD-R or a magnetic tape, a nonvolatile memory card, a ROM, etc. In addition, the program codes may be downloaded through a network, etc.

The OS operating on a computer may execute partially or entirely the actual processing based on an instruction of the program codes, thereby realizing the functions of the embodiment. Such a case is also included in the present invention.

Further, the program codes read from the storage medium are written in a memory included in an extension board inserted into a computer or in an extension unit connected to a computer. Thereafter, a CPU or the like included in the extension board or extension unit partially or entirely executes the actual processing based on an instruction of the program codes, thereby realizing the functions of the embodiment. Such a case is included in the present invention.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

What is claimed is:

1. An image forming apparatus comprising:

a plurality of paper cassettes each of which can contain different sizes of paper;

an input unit configured to input a document;

a detection unit configured to detect a paper size of the document;

a control unit configured to execute a set function, of an auto paper selection function for automatically selecting a paper size corresponding to the paper size detected by the detection unit from the plurality of paper cassettes;

an image forming unit configured to form an image on a recording paper based on the document input by the input unit; and an initial state setting unit configured to set the auto paper selection function in an initial state of the image forming apparatus when there are a plurality of sizes of paper to be selected in the image forming apparatus.

2. A method of controlling an image forming apparatus having a plurality of paper cassettes each of which can contain different sizes of paper, the method comprising:

inputting a document;

detecting a paper size of the document;

executing a set function, of an auto paper selection function for automatically selecting a paper size corresponding to the detected paper size from the plurality of paper cassettes;

forming an image on a recording paper based on the document input;

setting the auto paper selection function in an initial state of the image forming apparatus, when there are a plurality of sizes of paper to be selected in the image forming apparatus.

* * * * *